US007037571B2

(12) United States Patent
Fish et al.

(10) Patent No.: US 7,037,571 B2
(45) **Date of Patent: *May 2, 2006**

(54) DISPOSABLE SHOE LINER

(75) Inventors: Jeffrey E. Fish, Dacula, GA (US); Naveen Agarwal, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 51 days.

This patent is subject to a terminal disclaimer.

(21) Appl. No.: 10/029,132

(22) Filed: Dec. 20, 2001

(65) Prior Publication Data

US 2002/0092199 A1 Jul. 18, 2002

Related U.S. Application Data

(60) Provisional application No. 60/259,133, filed on Dec. 28, 2000.

(51) Int. Cl.
*B32B 3/00* (2006.01)
*A43B 21/32* (2006.01)

(52) U.S. Cl. ..... 428/166; 428/766; 428/172; 428/178; 428/217; 428/218; 36/37; 36/43; 36/71

(58) Field of Classification Search ..... 428/68, 428/71, 72, 76, 178, 172, 166, 217, 218; 36/43, 47, 49, 71, 37
See application file for complete search history.

(56) References Cited

U.S. PATENT DOCUMENTS

| | | | | |
|---|---|---|---|---|
| 1,780,574 | A | 11/1930 | Williams | |
| 2,121,604 | A | 6/1938 | Lynch et al. | |
| 3,143,812 | A | 8/1964 | Bittner | |
| 3,338,992 | A | 8/1967 | Kinney | |
| 3,341,394 | A | 9/1967 | Kinney | |
| 3,417,494 | A | 12/1968 | Claff | |
| 3,502,763 | A | 3/1970 | Hartmann | |
| 3,542,615 | A | 11/1970 | DoBo et al. | |
| 3,692,618 | A | 9/1972 | Dorschner et al. | |
| 3,802,817 | A | 4/1974 | Matsuki et al. | |
| 3,849,241 | A | 11/1974 | Butin et al. | |
| 3,852,897 | A | 12/1974 | Bridge et al. | |
| 3,855,046 | A | 12/1974 | Hansen et al. | |
| 3,881,491 | A | 5/1975 | Whyte | |
| 3,921,232 | A | 11/1975 | Whyte | |
| 4,015,347 | A | 4/1977 | Morishita et al. | |
| 4,017,931 | A * | 4/1977 | Golden | 36/44 |
| 4,055,180 | A | 10/1977 | Karami | |
| 4,055,699 | A | 10/1977 | Hsiung | |
| 4,087,506 | A | 5/1978 | Cook et al. | |
| 4,099,342 | A | 7/1978 | Singh | |
| 4,137,110 | A | 1/1979 | Singh | |

(Continued)

FOREIGN PATENT DOCUMENTS

| | | |
|---|---|---|
| EP | 0202127 B1 | 7/1992 |

(Continued)

*Primary Examiner*—Donald J. Loney
(74) *Attorney, Agent, or Firm*—Dority & Manning, P.A.

(57) ABSTRACT

A disposable shoe liner that is formed from a first substrate, a second substrate, and discrete regions of a functional material sandwiched therebetween is provided. In particular, the first and second substrates contain are fused together at certain portions such that fused portions and unfused portions are formed. The unfused portions form pockets that contain the functional material. In some embodiments, for example, the pockets contain activated carbon granules to provide comfort to the foot and to absorb odors exuded therefrom.

14 Claims, 4 Drawing Sheets

U.S. PATENT DOCUMENTS 4,185,402 A 1/1980 Digate
4,192,086 A 3/1980 Sichak
4,217,386 A 8/1980 Arons et al.
4,235,027 A 11/1980 Singh
4,260,443 A 4/1981 Lindsay et al.
4,323,534 A 4/1982 DesMarais
4,327,728 A 5/1982 Elias
4,333,463 A 6/1982 Holtman
4,340,563 A 7/1982 Appel et al.
4,360,021 A 11/1982 Stima
4,367,599 A * 1/1983 Diamant ..... 36/44
4,374,888 A 2/1983 Bornslaeger
4,381,783 A 5/1983 Elias
4,387,516 A 6/1983 Laux
4,464,850 A 8/1984 Ebert et al.
4,551,191 A 11/1985 Kock et al.
4,602,442 A 7/1986 Revill et al.
4,619,862 A 10/1986 Sokolowski et al.
4,642,912 A 2/1987 Wildman et al.
4,655,760 A 4/1987 Morman et al.
4,657,802 A 4/1987 Morman
4,658,515 A * 4/1987 Oatman ..... 36/44
4,663,220 A 5/1987 Wisneski et al.
4,670,011 A 6/1987 Mesek
4,685,909 A 8/1987 Berg et al.
4,715,918 A 12/1987 Lang
4,720,321 A 1/1988 Smith
4,720,415 A 1/1988 Vander Wielen et al.
4,724,184 A 2/1988 Killian et al.
4,781,966 A 11/1988 Taylor
4,789,699 A 12/1988 Kieffer et al.
4,800,102 A 1/1989 Takada
4,803,117 A 2/1989 Daponte
4,820,572 A 4/1989 Killian et al.
4,828,556 A 5/1989 Braun et al.
4,834,738 A 5/1989 Kielpikowski et al.
RE32,957 E 6/1989 Elias
4,843,739 A 7/1989 von Blucher et al.
4,864,740 A 9/1989 Oakley
4,892,535 A 1/1990 Bjornberg et al.
4,923,742 A 5/1990 Killian et al.
4,948,639 A 8/1990 Brooker et al.
4,960,477 A 10/1990 Mesek
4,965,122 A 10/1990 Morman
4,981,747 A 1/1991 Morman
4,994,053 A 2/1991 Lang
5,009,650 A 4/1991 Bernardin
5,017,324 A 5/1991 Kaiser et al.
5,028,224 A 7/1991 Pieper et al.
5,030,314 A 7/1991 Lang
5,032,446 A 7/1991 Sayles
5,093,422 A 3/1992 Himes
5,095,570 A 3/1992 Bar et al.
5,114,781 A 5/1992 Morman
5,116,662 A 5/1992 Morman
5,147,343 A 9/1992 Kellenberger
5,150,707 A 9/1992 Anderson
5,154,960 A 10/1992 Mucci et al.
5,175,046 A 12/1992 Nguyen
5,204,173 A 4/1993 Canary
5,216,825 A 6/1993 Brum
5,226,992 A 7/1993 Morman
5,233,769 A 8/1993 Weber
5,248,524 A 9/1993 Soderlund
5,304,599 A 4/1994 Himes
5,306,266 A 4/1994 Freeland
5,319,867 A 6/1994 Weber
5,332,613 A 7/1994 Taylor et al.
5,336,545 A 8/1994 Morman
5,342,333 A 8/1994 Tanzer et al.
5,364,380 A 11/1994 Tanzer et al.
5,385,775 A 1/1995 Wright
5,388,349 A 2/1995 Ogden
5,392,533 A 2/1995 Gerhartl
5,411,497 A 5/1995 Tanzer et al.
5,418,037 A 5/1995 Maeder et al.
5,425,725 A 6/1995 Tanzer et al.
5,433,715 A 7/1995 Tanzer et al.
5,451,219 A 9/1995 Suzuki et al.
5,494,622 A 2/1996 Heath et al.
5,562,645 A 10/1996 Tanzer et al.
5,591,510 A 1/1997 Junker et al.
5,593,399 A 1/1997 Tanzer et al.
5,601,542 A 2/1997 Melius et al.
5,649,914 A 7/1997 Glaug et al.
5,681,298 A 10/1997 Brunner et al.
5,702,376 A 12/1997 Glaug et al.
5,718,955 A 2/1998 McGuire et al.
5,727,336 A 3/1998 Ogden
5,753,357 A * 5/1998 Filipitsch et al. ..... 36/44
5,763,335 A 6/1998 Hermann
5,769,832 A 6/1998 Hasse
5,788,684 A 8/1998 Abuto et al.
5,814,188 A 9/1998 Vinson et al.
5,904,810 A 5/1999 Schroeder et al.
5,924,221 A 7/1999 Schuver et al.
5,938,650 A 8/1999 Baer et al.
5,962,117 A 10/1999 Furutani et al.
5,983,650 A 11/1999 Ando et al.
6,025,287 A 2/2000 Hermann
6,119,370 A 9/2000 Baron
6,138,383 A 10/2000 Steinke et al.
6,143,374 A 11/2000 Cairncross et al.

FOREIGN PATENT DOCUMENTS

WO WO 0115646 3/2001
WO WO 0115647 3/2001

* cited by examiner

DISPOSABLE SHOE LINER

RELATED APPLICATIONS

This application claims priority to U.S. Provisional Application Ser. No. 60/259,133, filed on Dec. 28, 2000.

BACKGROUND OF THE INVENTION

Various types of shoe liners have been developed to provide certain benefits to a user when wearing shoes inserted therewith. Some shoe liners, for instance, are designed to cushion the foot of a wearer. Foams or plastics filled with air or liquid, for example, have been utilized in forming shoe liners. However, many of such conventional shoe liners provide inadequate comfort to a user. Besides liners developed to cushion the foot of a user, liners have also been developed to serve other functions as well. For instance, liners have been developed to absorb odors exuded by a wearer's foot. For example, activated carbon particles have been utilized to reduce odors exuded from the foot. However, one problem experienced by many of such conventional liners is that the particles tend to move around and shift during use, thereby causing discomfort to the user and resulting in an inefficient use of the particles.

As such, a need currently exists for an improved disposable shoe liner that can be inserted into a shoe to comfort the foot of a wearer or impart some other functionality thereto.

SUMMARY OF THE INVENTION

In accordance with one embodiment of the present invention, a shoe is provided in which is placed a disposable shoe liner. The liner may contain a laminate structure shaped to approximate the contours of a foot. The laminate structure has a first substrate containing a thermoplastic polymer and a second substrate containing a thermoplastic polymer. The thermoplastic polymer of each substrate is fused together to form fused portions and unfused portions located between the fused portions. The unfused portions define pockets containing discrete regions of a functional material (e.g., particles, etc.).

For example, in some embodiments, the functional material can have a hardness that is greater than the hardness of the substrates to provide enhanced comfort and support to a user. In some embodiments, the functional material can contain a fragrance, an odor absorbent, a liquid absorbent, a germicidal material, or mixtures thereof. For instance, in one embodiment, the functional material can contain an odor absorbent, such as activated carbon granules. If desired, the functional material contained with a first group of the pockets can, in some embodiments, have a packing density that is greater than the packing density of the functional material contained with a second group of the pockets.

To form the disposable shoe liner, a variety of techniques may be utilized. For example, in some embodiments, the functional material is deposited onto the first substrate utilizing a deposition technique selected from the group consisting of vacuum screen, template, xerographic, electrostatic, print, and combinations thereof. Moreover, in some embodiments, the substrates can be fused together by a technique selected from the group consisting of thermal bonding, ultrasonic bonding, adhesive bonding, and combinations thereof.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which:

FIG. 2 is a schematic view of the steps for forming one embodiment of a disposable shoe liner of the present invention in which

Figure 1:
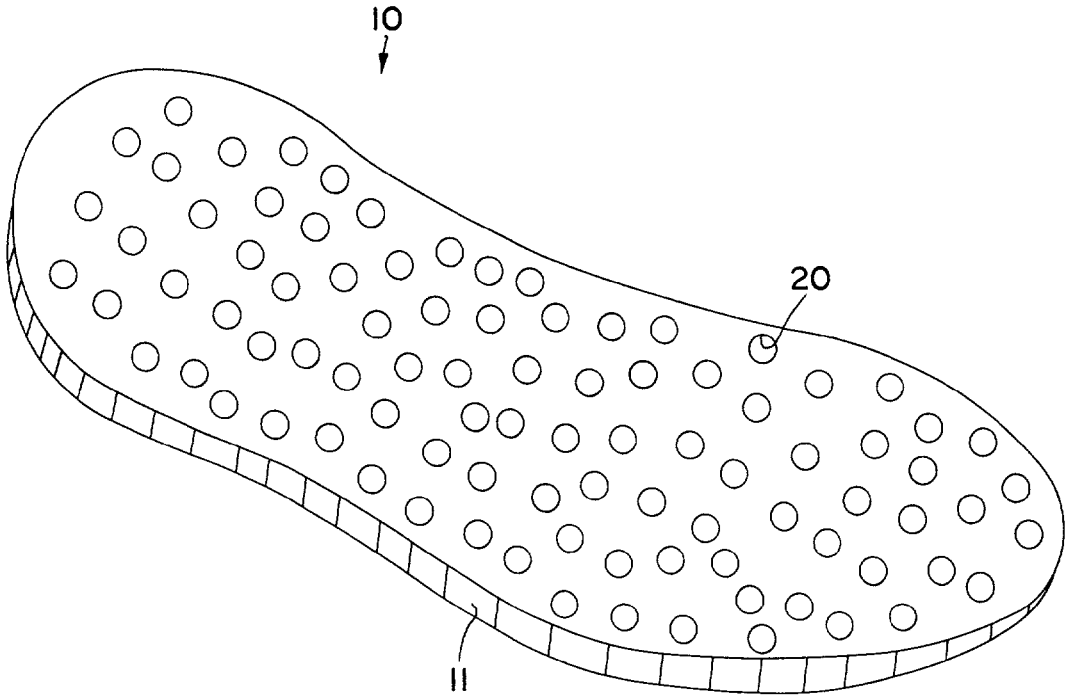
FIG. 1 is a perspective view of one embodiment of a disposable shoe liner of the present invention.

Repeat use of reference characters in the present specification and drawings is intended to represent same or analogous features or elements of the invention.

DETAILED DESCRIPTION OF REPRESENTATIVE EMBODIMENTS

Definitions

As used herein, the phrase "bonded carded web" refers to webs that are made from staple fibers which are sent through a combing or carding unit, which separates or breaks apart and aligns the staple fibers to form a nonwoven web. Once the web is formed, it then is bonded by one or more of several known bonding methods. One such bonding method is powder bonding, wherein a powdered adhesive is distributed through the web and then activated, usually by heating the web and adhesive with hot air. Another suitable bonding method is pattern bonding, wherein heated calender rolls or ultrasonic bonding equipment are used to bond the fibers together, usually in a localized bond pattern, though the web can be bonded across its entire surface if so desired. Another suitable and well-known bonding method, particularly when using bicomponent staple fibers, is through-air bonding.

As used herein, "meltblown fibers" refers to fibers formed by extruding a molten thermoplastic material through a plurality of fine, usually circular, die capillaries as molten threads or filaments into converging high velocity, usually hot gas (e.g., air) streams which attenuate the filaments of thermoplastic material to reduce their diameter, which may be to microfiber diameter. Thereafter, the meltblown fibers are carried by the high velocity gas stream and are deposited on a collecting surface to form a web of nearly randomly disbursed meltblown fibers. Such a process is disclosed, for example, in U.S. Pat. No. 3,849,241 to Butin et al. For example, meltblown fibers may be microfibers that are continuous or discontinuous and have a diameter smaller than 10 microns.

As used herein, the term "nonwoven web" or "nonwoven" refers to a web having a structure of individual fibers or threads which are interlaid, but not in an identifiable manner as in a knitted fabric. Nonwoven webs or fabrics have been formed from many processes, such as, for example, melt-blowing processes, spunbonding processes, and bonded carded web processes.

As used herein, the phrases "pattern unbonded", "point unbonded", or "PUB" generally refer to a fabric pattern having continuous thermally-bonded areas defining a plurality of discrete unbonded areas. The fibers or filaments within the discrete unbonded areas are dimensionally stabilized by the continuously bonded areas that encircle or surround each unbonded area. The unbonded areas are specifically designed to afford spaces between fibers or filaments within the unbonded areas. A suitable process for forming the pattern-unbonded nonwoven material of this invention, such as described in U.S. Pat. No. 5,962,117, includes passing a heated nonwoven fabric (e.g., nonwoven web or multiple nonwoven web layers) between calendar rolls, with at least one of the rolls having a bonding pattern on its outermost surface comprising a continuous pattern of land areas defining a plurality of discrete openings, indentions, apertures, or holes. Each of the openings in the roll (or rolls) defined by the continuous land areas forms a discrete unbonded area in at least one surface of the resulting nonwoven fabric in which the fibers or filaments are substantially or completely unbonded. Alternative embodiments of the process include pre-bonding the nonwoven fabric or web before passing the fabric or web within the nip formed by the calender rolls.

As used herein, "spunbond fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. No. 3,338,992 to Kinney, U.S. Pat. No. 3,341,394 to Kinney, U.S. Pat. No. 3,502,763 to Hartman, and U.S. Pat. No. 3,542,615 to Dobo et al. Spunbond fibers are generally not tacky when they are deposited on a collecting surface. Spunbond fibers are generally continuous and have diameters larger than about 7 microns, and more particularly, between about 10 and 40 microns.

As used herein, the phrase "thermal point bonding" generally refers to passing a fabric (e.g., fibrous web or multiple fibrous web layers) or webs to be bonded between heated calendar rolls. One roll is usually patterned in some way so that the entire fabric is not bonded across its entire surface, and the other roll is usually smooth. As a result, various patterns for calendar rolls have been developed for functional as well as aesthetic reasons. One example of a pattern that has points is the Hansen-Pennings or "H&P" pattern with about a 30% bond area with about 200 pins/square inch as taught in U.S. Pat. No. 3,855,046. The H&P pattern has square point or pin bonding areas. Another typical point bonding pattern is the expanded Hansen-Pennings or "EHP" bond pattern which produces a 15% bond area. Another typical point bonding pattern designated "714" has square pin bonding areas wherein the resulting pattern has a bonded area of about 15%. Other common patterns include a diamond pattern with repeating and slightly offset diamonds with about a 16% bond area and a wire weave pattern looking as the name suggests, e.g. like a window screen, with about an 18% bond area. Typically, the calender imparts from about 10% to about 30% bonded area of the resulting fabric. As is well known in the art, the point bonding holds the resulting fabric together.

As used herein, "ultrasonic bonding" generally refers a process performed, for example, by passing a substrate between a sonic horn and anvil roll, such as illustrated in U.S. Pat. No. 4,374,888 to Bornslaeger.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a shoe in which is placed a disposable shoe liner that is formed with pockets containing discrete regions of a functional material. For example, particles, such as cushioning or massaging agents, odor absorbents, antimicrobial agents, (e.g., antibacterial, antiviral, antifungal, etc.), sweat absorbents, and the like, can be utilized. It has been discovered that pockets containing discrete regions of a functional material can provide comfort to the foot of a user (e.g., massaging, cushioning, support, etc.), as well as other functional attributes (e.g., odor absorbency, etc.), when incorporated into the shoe liner of the present invention. Moreover, if desired the use of pockets can also allow the shoe liner to maintain its functionality over an extended period of time.

Referring to FIG. 1, for example, one embodiment of a disposable shoe liner 10 formed in accordance with the present invention is illustrated. The disposable shoe liner 10 is generally formed from a laminate structure that is shaped to approximate the contours of a foot. In some instances, as shown in FIG. 1, the disposable shoe liner 10 can be essentially flat. In other instances, the disposable shoe liner 10 can have other shapes, such as a sock-shape for covering the foot, ankle, or leg of a user.

Regardless of the particular shape utilized, the disposable shoe liner 10 is typically formed from two or more substrates that can each contain one or more layers. The substrates may be hydrophobic or hydrophilic. Moreover, the substrates can be made from a variety of different materials. For instance, in some embodiments, the substrates can be formed of a material such that at least a portion of the substrates are fusible when subjected to thermal, ultrasonic, adhesive, or other similar bonding techniques. If desired, the substrates can be generally free of cellulosic materials to enhance the ability of the substrates to be fused together. For example, a substrate used in the present invention can be formed from films, nonwoven webs, woven fabrics, knitted fabrics, or combinations thereof (e.g., nonwoven fabric laminated to a film).

Typically, the nonwoven webs contain synthetic fibers or filaments. The synthetic fibers or filaments may be formed from a variety of thermoplastic polymers. For example, some suitable thermoplastics include, but are not limited, poly(vinyl) chlorides; polyesters; polyamides; polyolefins (e.g., polyethylene, polypropylenes, polybutylenes, etc.); polyurethanes; polystyrenes; poly(vinyl) alcohols; copolymers, terpolymers, and blends of the foregoing; and the like.

Some suitable polyolefins, for example, may include polyethylenes, such as Dow Chemical's PE XU 61800.41 linear low density polyethylene ("LLDPE") and 25355 and 12350 high density polyethylene ("HDPE"). Moreover, other suitable polyolefins may include polypropylenes, such as Exxon Chemical Company's Escorene® PD 3445 polypropylene and Montell Chemical Co.'s PF-304 and PF-015.

Further, some suitable polyamides may be found in "Polymer Resins" by Don E. Floyd (Library of Congress Catalog No. 66-20811 Reinhold Publishing, New York, 1966). Commercially available polyamides that can be used include Nylon-6, Nylon 6,6, Nylon-11 and Nylon-12. These polyamides are available from a number of sources, such as Emser Industries of Sumter, S.C. (Grilon® & Grilamid® nylons), Atochem Inc. Polymers Division of Glen Rock, N.J. (Rilsan® nylons), Nyltech of Manchester, NH. (grade 2169, Nylon 6), and Custom Resins of Henderson, Ky. (Nylene 401-D), among others.

In some embodiments, bicomponent fibers can also be utilized. Bicomponent fibers are fibers that can contain two materials such as but not limited to in a side-by-side arrangement, in a matrix-fibril arrangement wherein a core polymer has a complex cross-sectional shape, or in a core and sheath arrangement. In a core and sheath fiber, generally the sheath polymer has a lower melting temperature than the core polymer to facilitate thermal bonding of the fibers. For instance, the core polymer, in one embodiment, can be nylon or a polyester, while the sheath polymer can be a polyolefin such as polyethylene or polypropylene. Such commercially available bicomponent fibers include "CELBOND" fibers marketed by the Hoechst Celanese Company.

As stated above, one or more films may also be utilized in forming a substrate of the disposable shoe liner 10. To form the films, a variety of materials can be utilized. For instance, some suitable thermoplastic polymers used in the fabrication of films can include, but are not limited to, polyolefins (e.g., polyethylene, polypropylene, etc.), including homopolymers, copolymers, terpolymers and blends thereof; ethylene vinyl acetate; ethylene ethyl acrylate; ethylene acrylic acid; ethylene methyl acrylate; ethylene normal butyl acrylate; polyurethane; poly(ether-ester); poly (amid-ether) block copolymers; and the like.

The permeability of the substrates can also be varied for a particular application. For example, in some embodiments, one or more of the substrates can be permeable to liquids. In other embodiments, one or more of the substrates can be impermeable to liquids, such as films formed from polypropylene or polyethylene. In addition, in other embodiments, it may be desired that one or more of the substrates be impermeable to liquids, but permeable to gases and water vapor (i.e., breathable).

Moreover, in some embodiments, one or more of the substrates used in the disposable shoe liner 10 can contain an elastomeric component that includes at least one elastomeric material. For example, an elastomeric or elastic material can refer to material that, upon application of a force, is stretchable to a stretched, biased length which is at least about 150%, or one and a half times, its relaxed, unstretched length, and which will recover at least about 50% of its elongation upon release of the stretching, biasing force. In some instances, an elastomeric component can enhance the flexibility of the resulting shoe liner 10 by enabling it to be more easily bent and distorted. When present in a substrate, the elastomeric component can take on various forms. For example, the elastomeric component can make up the entire substrate or form a portion of the substrate. In some embodiments, for instance, the elastomeric component can contain elastic strands or sections uniformly or randomly distributed throughout the substrate. Alternatively, the elastomeric component can be an elastic film or an elastic nonwoven web. The elastomeric component can also be a single layer or a multi-layered material.

In general, any material known in the art to possess elastomeric characteristics can be used in the elastomeric component. For example, suitable elastomeric resins include block copolymers having the general formula A-B-A' or A-B, where A and A' are each a thermoplastic polymer endblock which contains a styrenic moiety such as a poly (vinyl arene) and where B is an elastomeric polymer midblock such as a conjugated diene r a lower alkene polymer. Block copolymers for the A and A' blocks, and the present block copolymers are intended to embrace linear, branched and radial block copolymers. In this regard, the radial block copolymers may be designated (A-B)m-X, wherein X is a polyfunctional atom or molecule and in which each (A-B)m-radiates from X in a way that A is an endblock. In the radial block copolymer, X may be an organic or inorganic polyfunctional atom or molecule and m may be an integer having the same value as the functional group originally present in X, which is usually at least 3, and is frequently 4 or 5, but not limited thereto. Thus, the expression "block copolymer," and particularly "A-B-A" and "A-B" block copolymers, can include all block copolymers having such rubbery blocks and thermoplastic blocks as discussed above, which can be extruded (e.g., by meltblowing), and without limitation as to the number of blocks. For example, elastomeric materials, such as (polystyrene/poly(ethylene-butylene)/polystyrene) block copolymers, can be utilized. Commercial examples of such elastomeric copolymers are, for example, those known as KRATON® materials which are available from Shell Chemical Company of Houston, Tex. KRATON® block copolymers are available in several different formulations, a number of which are identified in U.S. Pat. Nos. 4,663,220, 4,323,534, 4,834,738, 5,093,422 and 5,304,599, which are hereby incorporated in their entirety by reference thereto for all purposes.

Polymers composed of an elastomeric A-B-A-B tetrablock copolymer may also be used. Such polymers are discussed in U.S. Pat. No. 5,332,613 to Taylor et al. In these polymers, A is a thermoplastic polymer block and B is an isoprene monomer unit hydrogenated to substantially a poly(ethylene-propylene) monomer unit. An example of such a tetrablock copolymer is a styrene-poly(ethylene-propylene)-styrene-poly(ethylene-propylene) or S-EP-S-EP elastomeric block copolymer available from the Shell Chemical Company of Houston, Texas under the trade designation KRATON® G-1657.

Other exemplary elastomeric materials that may be used include polyurethane elastomeric materials such as, for example, those available under the trademark ESTANE® from B.F. Goodrich & Co. or MORTHANE® from Morton Thiokol Corp., and polyester elastomeric materials such as, for example, copolyesters available under the trade designation HYTREL® from E. I. DuPont De Nemours & Company and copolyesters known as ARNITEL®, formerly available from Akzo Plastics of Amhem, Holland and now available from DSM of Sittard, Holland.

Another suitable material is a polyester block amide copolymer having the formula:

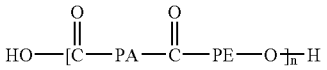

where n is a positive integer, PA represents a polyamide polymer segment and PE represents a polyether polymer segment. In particular, the polyether block amide copolymer has a melting point of from about 150° C to about 170° C, as measured in accordance with ASTM D-789; a melt index of from about 6 grams per 10 minutes to about 25 grams per 10 minutes, as measured in accordance with ASTM D-1238, condition Q (235 C/1 Kg load); a modulus of elasticity in flexure of from about 20 Mpa to about 200 Mpa, as measured in accordance with ASTM D-790; a tensile strength at break of from about 29 Mpa to about 33 Mpa as measured in accordance with ASTM D-638 and an ultimate elongation at break of from about 500 percent to about 700 percent as measured by ASTM D-638. A particular embodiment of the polyether block amide copolymer has a melting point of about 152° C. as measured in accordance with ASTM D-789; a melt index of about 7 grams per 10 minutes, as measured in accordance with ASTM D-1238, condition Q (235 C/1 Kg load); a modulus of elasticity in flexure of about 29.50 Mpa, as measured in accordance with ASTM D-790; a tensile strength at break of about 29 Mpa, as measured in accordance with ASTM D-639; and an elongation at break of about 650 percent, as measured in accordance with ASTM D-638. Such materials are available in various grades under the trade designation PEBAX® from ELF Atochem Inc. of Glen Rock, N.J. Examples of the use of such polymers may be found in U.S. Pat. Nos. 4,724,184, 4,820,572 and 4,923,742 to Killian.

Elastomeric polymers can also include copolymers of ethylene and at least one vinyl monomer such as, for example, vinyl acetates, unsaturated aliphatic monocarboxylic acids, and esters of such monocarboxylic acids. The elastomeric copolymers and formation of elastomeric nonwoven webs from those elastomeric copolymers are disclosed in, for example, U.S. Pat. No. 4,803,117.

The thermoplastic copolyester elastomers include copolyetheresters having the general formula:

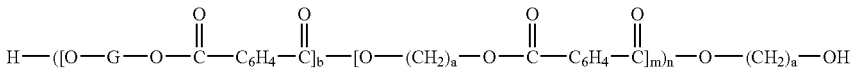

where "G" is selected from the group consisting of poly(oxyethylene)-alpha, omega-diol, poly(oxypropylene)-alpha, omega-diol, poly(oxytetramethylene)-alpha, omega-diol and "a" and "b" are positive integers including 2, 4 and 6, "m" and "n" are positive integers including 1–20. Such materials generally have an elongation at break of from about 600 percent to 750 percent when measured in accordance with ASTM D-638 and a melt point of from about 350° F. to about 400° F. (176 to 205° C.) when measured in accordance with ASTM D-2117.

In addition, some examples of suitable elastomeric olefin polymers are available from Exxon Chemical Company of Baytown, Tex. under the trade name ACHIEVE® for polypropylene based polymers and EXACT® and EXCEED® for polyethylene based polymers. Dow Chemical Company of Midland, Mich. has polymers commercially available under the name ENGAGE®. These materials are believed to be produced using non-stereoselective metallocene catalysts. Exxon generally refers to their metallocene catalyst technology as "single site" catalysts, while Dow refers to theirs as "constrained geometry" catalysts under the name INSIGHT® to distinguish them from traditional Ziegler-Natta catalysts which have multiple reaction sites.

When incorporating an elastomeric component containing an elastomeric material, such as described above, into a substrate, it is sometimes desired that the elastomeric component be an elastic laminate that contains an elastomeric material with one or more other layers, such as foams, films, apertured films, and/or nonwoven webs. An elastic laminate generally contains layers that can be bonded together so that at least one of the layers has the characteristics of an elastic polymer. The elastic material used in the elastic laminates can be made from materials, such as described above, that are formed into films, such as a microporous film, fibrous webs, such as a web made from meltblown fibers, spunbond fibers, foams, and the like.

For example, in one embodiment, the elastic laminate can be a "neck-bonded" laminate. A "neck-bonded" laminate refers to a composite material having at least two layers in which one layer is a necked, non-elastic layer and the other layer is an elastic layer. The resulting laminate is thereby a material that is elastic in the cross-direction. Some examples of neck-bonded laminates are described in U.S. Pat. Nos. 5,226,992, 4,981,747, 4,965,122, and 5,336,545, all to Morman, all of which are incorporated herein in their entirety by reference thereto for all purposes.

The elastic laminate can also be a "stretch-bonded" laminate, which refers to a composite material having at least two layers in which one layer is a gatherable layer and in which the other layer is an elastic layer. The layers are joined together when the elastic layer is in an extended condition so that upon relaxing the layers, the gatherable layer is gathered. For example, one elastic member can be bonded to another member while the elastic member is extended at least about 25 percent of its relaxed length. Such a multilayer composite elastic material may be stretched until the nonelastic layer is fully extended.

For example, one suitable type of stretch-bonded laminate is a spunbonded laminate, such as disclosed in U.S. Pat. No. 4,720,415 to VanderWielen et al., which is incorporated herein in its entirety by reference thereto for all purposes. Another suitable type of stretch-bonded laminate is a continuous filament spunbonded laminate, such as disclosed in U.S. Pat. No. 5,385,775 to Wright, which is incorporated herein in its entirety by reference thereto for all purposes. For instance, Wright discloses a composite elastic material that includes: (1) an anisotropic elastic fibrous web having at least one layer of elastomeric meltblown fibers and at least one layer of elastomeric filaments autogenously bonded to at least a portion of the elastomeric meltblown fibers, and (2) at least one gatherable layer joined at spaced-apart locations to the anisotropic elastic fibrous web so that the gatherable layer is gathered between the spaced-apart locations. The gatherable layer is joined to the elastic fibrous web when the elastic web is in a stretched condition so that when the elastic web relaxes, the gatherable layer gathers between the spaced-apart bonding locations. Other composite elastic materials are described and disclosed in U.S. Pat. No. 4,789,699 to Kieffer et al., U.S. Pat. No. 4,781,966 to Taylor, U.S. Pat. No. 4,657,802 to Morman, and U.S. Pat. No. 4,655,760 to Morman et al., all of which are incorporated herein in their entirety by reference thereto for all purposes.

In one embodiment, the elastic laminate can also be a necked stretch bonded laminate. As used herein, a necked stretch bonded laminate is defined as a laminate made from the combination of a neck-bonded laminate and a stretch-bonded laminate. Examples of necked stretch bonded laminates are disclosed in U.S. Pat. Nos. 5,114,781 and 5,116,662, which are both incorporated herein in their entirety by reference thereto for all purposes. Of particular advantage, a necked stretch bonded laminate can be stretchable in both the machine and cross-machine directions.

Besides containing substrates, such as described above, it should be understood that the disposable shoe liner 10 can also contain additional materials as well. For instance, one or more layers may be utilized for the surface of the shoe liner 10 contacting the foot to provide additional comfort to the wearer. Layers that may provide such additional comfort can include, for example, woven materials, felt, foams, etc. Moreover, in some instances, additional layers can also be utilized for the surface of the shoe liner 10 contacting the inner surface of a shoe (not shown) to provide increased traction to the liner 10 during use. In some embodiments, for example, as shown in FIG. 1, a layer 11 can be utilized to enhance the grip of the disposable shoe liner 10 to the inner surface of a shoe to ensure that the liner 10 does not substantially slide and/or move around during use.

As stated above, a functional material is also provided for deposition onto one or more of the substrates used in forming the shoe liner 10. As used herein, the term "functional material" generally refers to any material that provides some functional benefit to the laminate structure. Thus, a functional material may encompass a material that is chemically reactive or inert, as long as the material provides some functional attribute to the resulting structure. For example, if desired, the functional material may be a chemically inert material that is utilized to simply add weight to the shoe liner. Moreover, the functional material may also have a variety of different forms. For example, the functional material may contain particles, liquids (e.g., water, oils, etc.), and the like. When utilized, particles may be of any size, shape, and/or type. For example, the particles may be spherical or semispherical, cubic, rod-like, polyhedral, etc., while also including other shapes, such as needles, flakes, and fibers.

In accordance with one embodiment of the present invention, a functional material can sometimes be utilized to comfort the foot. For instance, a disposable shoe liner of the present invention can utilize a functional material that helps massage, support, cushion, etc., the foot. For example, the functional material can be relatively hard so that, when incorporated into the pockets 20 of the shoe liner 10, it acts to massage and/or support the foot. In this regard, any functional material having the desired hardness characteristics can be utilized. For example, in one embodiment, particles can be utilized that have a hardness greater than the hardness of the substrates enclosing the particles. Moreover, the functional material may also be relatively soft and flexible so that it acts as a cushion.

If desired, the functional material may also possess certain properties for providing additional benefits to a wearer of the shoe liner 10. For example, some suitable functional materials that can be utilized include, but are not limited to, odor absorbents, fragrances, germicidal materials (e.g., agents that are antiviral, antibacterial, antifungal, etc.), liquid absorbents (e.g., materials for absorbing sweat), mixtures thereof, and the like. For instance, in one embodiment, activated carbon granules can be incorporated into the pockets 20 to absorb odors exuded from a foot, and in some instances, to also provide comfort to the foot.

The functional material can generally be deposited onto the substrate using a variety of deposition techniques. For instance, in some embodiments, a template can be utilized to deposit the functional material in a desired pattern. Specifically, a template can have a structure that enables it to physically inhibit the areas that are to be bonded from being deposited with the functional material. In addition, in some embodiments, vacuum plates can be utilized. Vacuum plates use suctional forces to draw the functional material to the desired areas. Moreover, adhesive deposition can also be used. For example, an adhesive can be applied to the substrate where it is desired for the functional material to be deposited. The functional material will then selectively adhere to those portions of the substrate containing the adhesive.

Further, in some embodiments, one or more of the substrates can be textured such that the substrate contains depressions and elevations. In such instances, the functional material can be deposited onto the textured substrate such that they collect substantially in the depressions of the substrate. Besides the above-mentioned techniques of deposition, other techniques can also be utilized. For instance, some other known techniques for depositing a functional material onto a substrate can include, but are not limited to, electrostatic, xerographic, printing (e.g., gravure), patterned transfer roll (vacuum or adhesive), and the like.

Figure 2A:
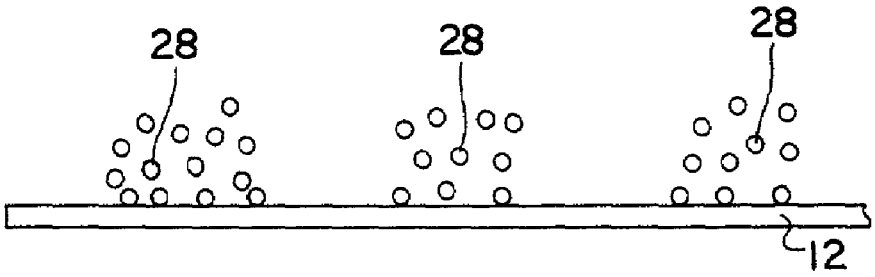
FIG. 2A illustrates particles deposited onto a first substrate.
Figure 2B:
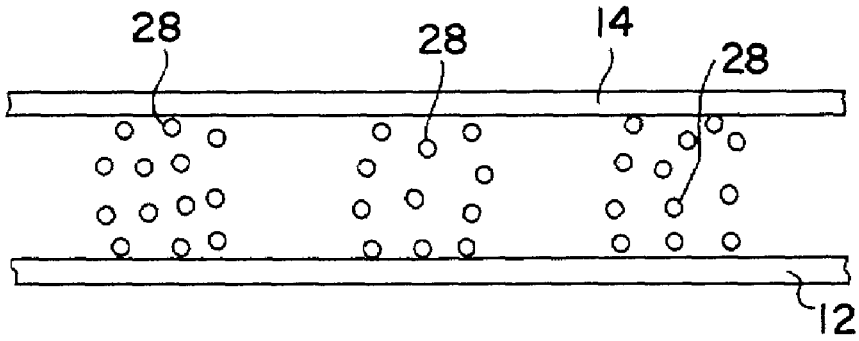
FIG. 2B illustrates a second substrate placed over the particles.
Figure 2C:
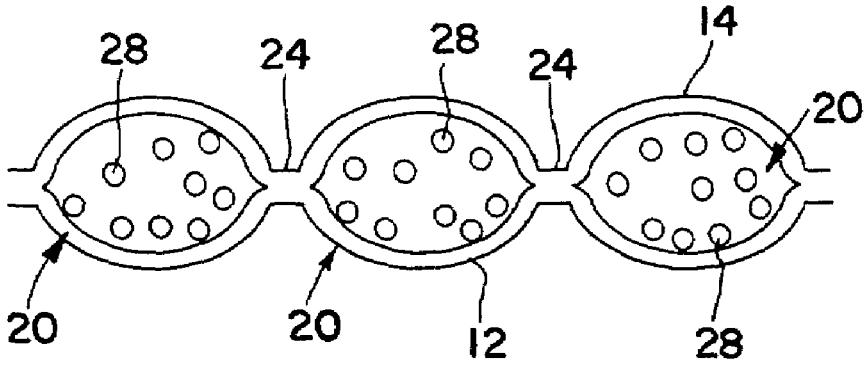
FIG. 2C illustrates the two substrates fused together.

Once deposited, the functional material may then be enclosed within the substrates using a variety of techniques. For example, referring to FIG. 2, one embodiment of a method for enclosing a particulate functional material 28 within two substrates is illustrated. As shown in FIG. 2A, the particles 28 are initially deposited onto a first substrate 12. Once deposited, a second substrate 14 is then fused to portions of the first substrate 12. As shown in FIGS. 2B–2C, the second substrate 14 is then fused to the first substrate 12 at certain fused portions 24.

To fuse the substrates 12 and 14 together, a variety of methods can be utilized. In particular, any method that allows the substrates 12 and 14 to be fused together in a pattern corresponding to the portions of the substrate 12 that do not contain the discrete regions of the particles 28 can be utilized. For instance, thermal bonding techniques, such as thermal point bonding, pattern unbending, etc., and ultrasonic bonding are some examples of techniques that may be utilized in the present invention to fuse together the substrates. In addition, adhesives may also be utilized to fuse the substrates 12 and 14 together. For example, some suitable adhesives are described in U.S. Pat. No. 5,425,725 to Tanzer, et al.; U.S. Pat. No. 5,433,715 to Tanzer, et al.; and U.S. Pat. No. 5,593,399 to Tanzer, et al. which are incorporated herein in their entirety by reference thereto for all purposes.

Figure 5:
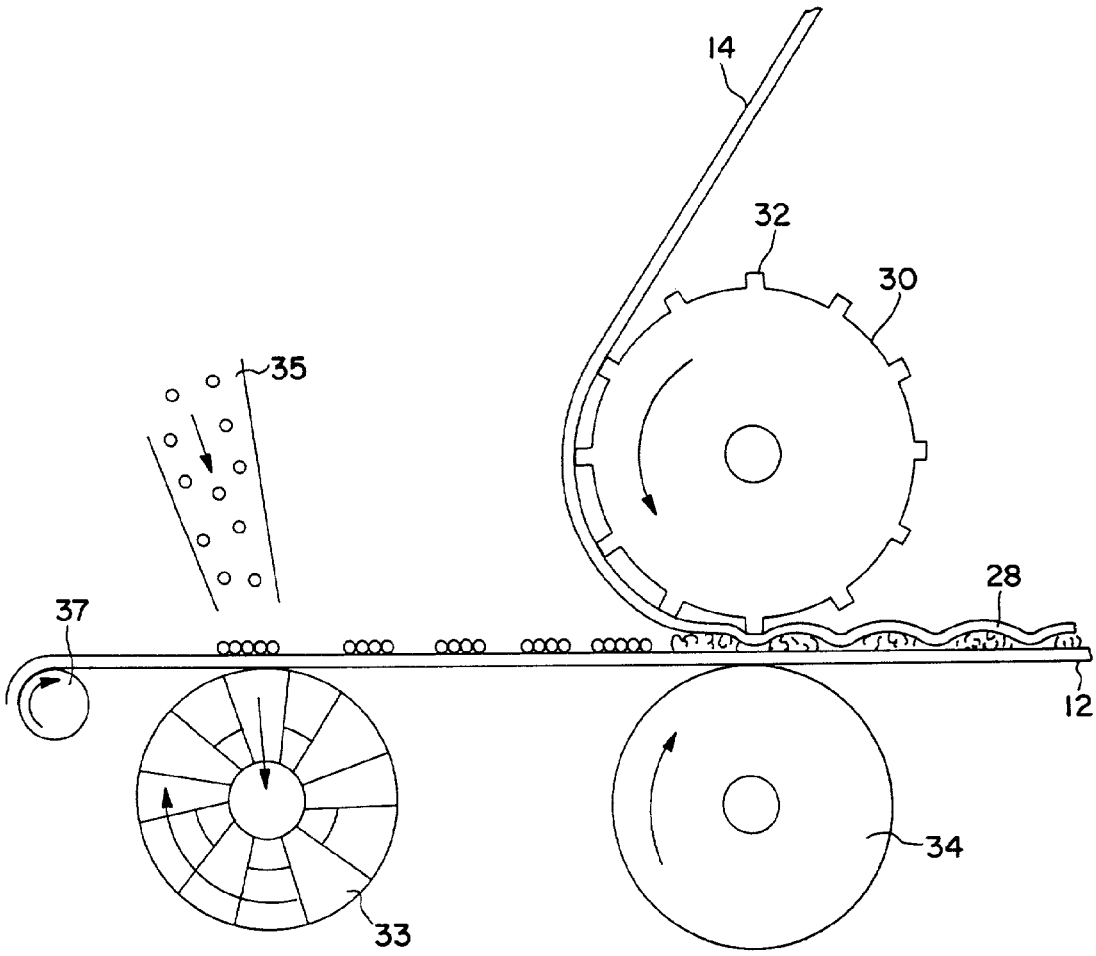
FIG. 5 is a schematic illustration of one technique that can be utilized to form one embodiment of a disposable shoe liner of the present invention.

Referring to FIG. 5, one particular embodiment for fusing the second substrate 14 to the substrate 12 is illustrated. As shown, a functional material 28 is first deposited by a dispenser 35 onto the substrate 12 in a preselected pattern. The substrate 12 is moved under the dispenser 35 with the aid of a roll 37. Further, in this embodiment, to facilitate deposition of the functional material 28 onto the substrate 12, a vacuum roll 33 is utilized. In particular, the vacuum roll 33 can apply a suctional force to the lower surface of the substrate 12 to better control the positioning of the functional material 28 within a discrete region of the substrate 12.

Thereafter, the substrate 12 is passed beneath the substrate 14. In this embodiment, each substrate 12 and 14 contains a heat-fusible material, such as polypropylene. As shown, the substrates 12 and 14 are passed under a roll 30 that is heated and contains a surface having various protrusions 32. The protrusions 32 form a pattern that corresponds to portions of the substrate 12 that do not contain the functional material 28. In this embodiment, another heated roll 34 that has a smooth surface is also utilized to facilitate the fusing of the substrates 12 and 14. However, it should be understood that the roll 34 is not required in all instances. Moreover, the roll 34 may also have a certain pattern of protrusions and/or may remain unheated. In the illustrated embodiment, as the heated rolls 30 and 34 press the fusible substrates 12 and 14, the areas at the protrusions 32 are fused together, forming fused areas surrounding the pockets 20 containing the functional material 28.

In some instances, it may be desired to control the level of bonding for the disposable shoe liner 10. For example, in some embodiments, the bonded surface area can be between about 10% to about 500% of the unbonded area, in some embodiments, between about 10% to about 100% of the unbonded area, and in some embodiments, between about 40% to about 60% of the unbonded area.

As a result of being fused together, such as described above, discrete regions of the functional material 28 can be contained within unfused portions or pockets 20. In some embodiments, the packing density of the functional material 28 within the pockets 20 can be varied. In particular, for applications in which a harder liner 10 is desired, the packing density of the functional material 28 can be increased. In other instances, when a softer liner 10 is desired, the packing density can be decreased. Moreover, the packing density for the functional material 28 within the pockets 20 can also vary throughout the shoe liner 10. Specifically, it may be desired that certain portions of the liner 10 be harder than other portions of the liner 10, or it may be desired that certain portions of the liner 10 have a greater functionality than other portions of the liner 10. For instance, it is sometimes desired to have portions of the shoe liner 10 corresponding to the heel of a foot that are harder to provide more support to the heel. In such instances, the packing density of the pockets 20 corresponding to the heel can be greater than the packing density of other pockets of the shoe liner 10. Moreover, it is sometimes desired to provide more antifungal functionality, for example, to the areas near the toes of the foot. In such instances, the pockets 20 of the shoe liner 10 corresponding to the toes of the foot may have a greater packing density.

Moreover, the pockets 20 of the shoe liner 10 may also be generally formed to have any desired shape. For example, the pockets 20 can have regular or irregular shapes. Some regular shapes can include, for example, circles, ovals, squares, hexagons, rectangles, hourglass-shaped, tube-shaped, etc. In some instances, the shape of the pockets 20 can be selected to provide the optimum level of support or comfort to a user of the shoe liner 10. Moreover, some pockets 20 of the shoe liner 10 may also have different shapes than other pockets 20. For instance, a certain shape may be utilized for the portion of the shoe liner 10 corresponding to the heel of a foot, while another shape may be utilized for the remaining portions of the shoe liner 10.

Figure 3:
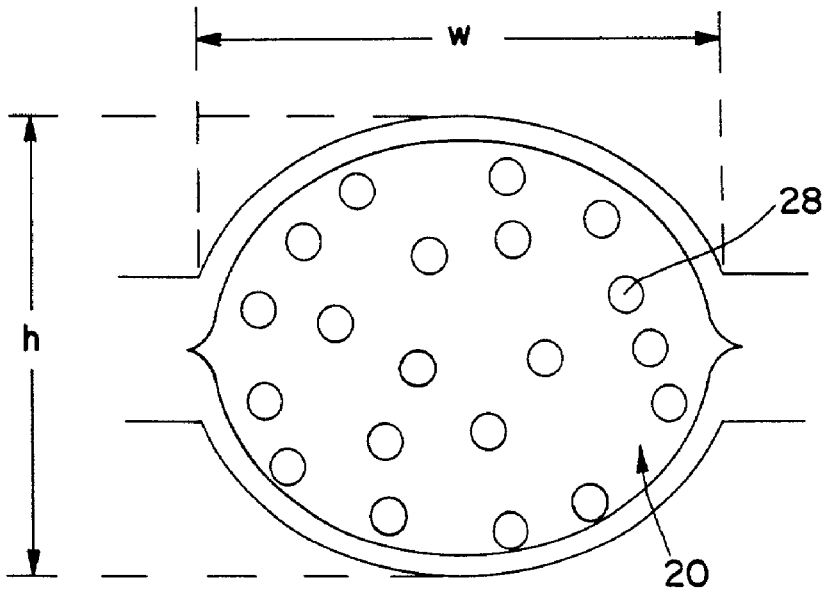
FIG. 3 is a side view of one embodiment of a pocket formed in accordance with one embodiment of the present invention.

Besides varying the shape of the pockets 20, the size of the pockets 20 may also be varied for certain applications. For example, in some embodiments, as shown in FIG. 3, the approximate width "w" to height "h" ratio of the pockets 20 (i.e., w/h) can, in some embodiments, be less than 10, in some embodiments between about 1 to about 8, and in some embodiments, between 1 to about 5. For example, in some embodiments, the approximate height "h" can be equal to less than about 1 inch, in some embodiments less than about 0.5 inches, and in some embodiments, between about 0.005 inches to about 0.4 inches.

Figure 4:
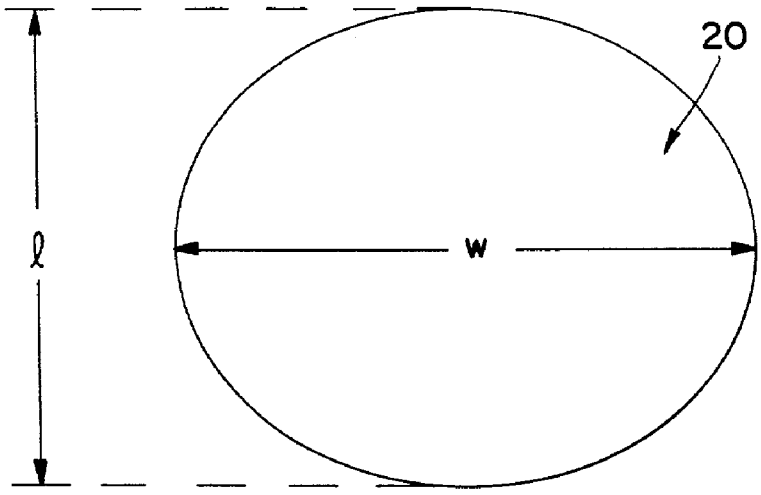
FIG. 4 is a plan view of the pocket shown in FIG. 3.

Further, as shown in FIG. 4, the approximate length "l" to width "w" ratio of the pockets 20 (i.e., l/w) can, in some embodiments, be less than about 100, in some embodiments, less than about 50, and in some embodiments, between about 1 to about 20. For example, in some embodiments, the approximate length dimension "l" of the pockets 20 can be less than about 2 inches, in some embodiments between about 0.0625 inches to about 2 inches, and in some embodiments, between about 0.25 inches to about 2 inches. Moreover, as stated above, the size of the pockets 20 for certain portions of the shoe liner 10 may be different than the size of the pockets 20 for other portions of the shoe liner 10.

In addition, the number of pockets 20 can also be varied. For instance, to provide additional massaging, support, cushioning, and/or other functionality, a greater number of pockets 20 containing the functional material 28 can be utilized. Furthermore, as noted above, it may sometimes be desired to provide certain portions of the foot with greater comfort. Moreover, it may also be desired to provide more functionality to certain portions of the shoe liner 10. As such, in some embodiments, a greater number of pockets 20 can be provided at such portions, while a lesser number of pockets 20 can be provided at the other portions. For example, to provide the heel of a foot with more comfort, the shoe liner 10 can have more pockets 20 at the regions of the liner 10 corresponding to the heel than other regions of the liner 10.

Once formed, the disposable shoe liner 10 may be secured to the foot of a wearer (e.g., secured directly to a sock or to the foot) and then inserted into the shoe. For example, in some embodiments, the shoe liner 10 can be secured to a foot using elastic bands. The elastic bands may be placed around the toes, ankle, and the like. Further, other attachment devices, such as adhesives, can also be utilized. Besides being secured to a foot, the shoe liner 10 may also be directly secured to the inner surface of a shoe. For example, adhesives may, if desired, be utilized to secure the shoe liner 10 to the inner surface of a shoe. When using an adhesive to secure the liner 10 to a foot or inner surface of a shoe, it is typically desired that the bonding strength be great enough to secure the liner 10 to the foot, but weak enough to be easily removed after use.

In addition, when secured to the foot of a user, the shoe liner 10 can be formed such that it is thin enough to be more comfortably worn under the socks of the wearer. For example, in some embodiments, the shoe liner 10 can contain a substrate having a thickness less than about 0.1 inches, in some embodiments between about 0.005 inches to about 0.06 inches, and in some embodiments, between about 0.015 inches to about 0.03 inches. If desired, as stated above, other layers, such as foam layers, can also be utilized. In such instances, the thickness of these additional layers may, for example, be between about 0.625 inches to about 0.25 inches.

As stated above, a shoe liner of the present invention can provide numerous benefits to a user. For example, the shoe liner can be designed to comfort the foot of a user by providing support, cushioning, massaging, and the like. In addition, the shoe liner of the present invention is disposable so that, if desired, a user can frequently (e.g., daily) substitute a used liner for a new liner.

The present invention may be better understood with reference to the following example.

EXAMPLE

The ability to form a disposable shoe liner of the present invention was demonstrated. Initially, two 9"×9" panels were cut out of a polypropylene meltblown nonwoven web (basis weight of 2.0 ounces per square yard). An outline of a foot was drawn on one of the panels, which was then placed on a 12"×12" metal plate having 3" diameter holes that were staggered to yield a hexagonal pattern. The plate had an open area of 40%. An identical second metal plate was then placed over the meltblown panel resting on the first metal plate such that the holes in the two metal plates were aligned.

Thereafter, approximately 4 grams of activated carbon granules (type APA 12×40 from Calgon Carbon Corp., Pittsburgh, Pa.) were placed in the holes through the top metal plate. After depositing the carbon granules, the top metal plate was carefully removed to yield a pattern of activated carbon granules in circular piles over the meltblown panel. The second meltblown panel was then placed over the first panel without disturbing the piles of activated carbon granules.

Once the panels were in place, the second metal plate was again placed over the meltblown panels containing the activated carbon granules so that the holes in the top plate were positioned over the holes in the bottom plate. The metal plate assembly was then placed inside a Carver Laboratory Press and heated to 160° C. A hydraulic pressure of approximately 20,000 pounds per square inch was applied to the plate assembly for about 3 minutes.

After the indicated processing time, the plate assembly was taken out of the press and allowed to cool. The cooled nonwoven laminate was then removed and a disposable shoe liner was cut from the outline of the foot on the panels using a pair of scissors. The resulting disposable shoe liner thus contained activated carbon granules in discrete pockets.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A disposable shoe liner comprising:

a laminate structure shaped to approximate the contours of a foot, said laminate structure comprising a first substrate containing a thermoplastic polymer and a second substrate containing a thermoplastic polymer, at least one of said substrates comprising a nonwoven web, wherein the thermoplastic polymer of said first substrate is fused together with the thermoplastic polymer of said second substrate to form fused portions and unfused portions located between said fused portions, said unfused portions defining pockets containing discrete regions of a functional material that is capable of providing comfort to the foot of a user, wherein said functional material has a hardness that is greater than the hardness of said first substrate and said second substrate.

2. A disposable shoe liner as defined in claim 1, wherein said functional material contains particles.

3. A disposable shoe liner as defined in claim 1, wherein said functional material contains a fragrance, an odor absorbent, a liquid absorbent, a germicidal material, or mixtures thereof.

4. A disposable shoe liner as defined in claim 1, wherein said functional material contains an odor absorbent.

5. A disposable shoe liner as defined in claim 4, wherein said odor absorbent includes activated carbon granules.

6. A disposable shoe liner as defined in claim 1, wherein at least one of said substrates contains a film.

7. A disposable shoe liner as defined in claim 1, wherein at least one of said substrates contains an elastomeric component.

8. A disposable shoe liner comprising:

a laminate structure shaped to approximate the contours of a foot, said laminate structure comprising a first substrate containing a thermoplastic polymer and a second substrate containing a thermoplastic polymer, at least one of said substrates comprising a nonwoven web, wherein the thermoplastic polymer of said first substrate is fused together with the thermoplastic polymer of said second substrate to form fused portions and unfused portions located between said fused portions, said unfused portions defining pockets containing discrete regions of a functional material that is capable of providing comfort to the foot of a user, wherein the functional material contained within a first group of said pockets has a packing density that is greater than the packing density of the functional material contained within a second group of said pockets.

9. A disposable shoe liner as defined in claim 8, wherein said functional material contains particles.

10. A disposable shoe liner as defined in claim 8, wherein said functional material contains a fragrance, an odor absorbent, a liquid absorbent, a germicidal material, or mixtures thereof.

11. A disposable shoe liner as defined in claim 8, wherein said functional material contains an odor absorbent.

12. A disposable shoe liner as defined in claim 11, wherein said odor absorbent includes activated carbon granules.

13. A disposable shoe liner as defined in claim 8, wherein at least one of said substrates contains a film.

14. A disposable shoe liner as defined in claim 8, wherein at least one of said substrates contains an elastomeric component.

* * * * *